US006360545B1

(12) United States Patent
Goldstone et al.

(10) Patent No.: US 6,360,545 B1
(45) Date of Patent: Mar. 26, 2002

(54) CONTAINMENT ENCLOSURE

(75) Inventors: Peter G. Goldstone, Woking; Rodney J. Allam, Guildford, both of (GB)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/719,762

(22) PCT Filed: Jun. 14, 1999

(86) PCT No.: PCT/GB99/01874

§ 371 Date: Dec. 14, 2000

§ 102(e) Date: Dec. 14, 2000

(87) PCT Pub. No.: WO99/66154

PCT Pub. Date: Dec. 23, 1999

(30) Foreign Application Priority Data

Jun. 16, 1998 (GB) ..... 9813001

(51) Int. Cl.[7] ..... F25D 23/12; E04B 1/74; F17C 1/00

(52) U.S. Cl. ..... 62/45.1; 62/259.1; 52/404.2; 52/407.4

(58) Field of Search ..... 62/45.1, 907, 259.1, 62/53.1; 52/302.4, 407.4, 404.2, 404.4, 519

(56) References Cited

U.S. PATENT DOCUMENTS

| | | | | | |
|---|---|---|---|---|---|
| 3,688,938 A | * | 9/1972 | Yamamoto et al. | ..... | 220/9 LG |
| 3,701,262 A | * | 10/1972 | Connell et al. | ..... | 62/45.1 |
| 3,754,675 A | * | 8/1973 | Richard et al. | ..... | 220/9 LG |
| 3,818,664 A | * | 6/1974 | Hillberg et al. | ..... | 52/309 |
| 4,041,722 A | | 8/1977 | Terlesky et al. | ..... | 62/45 |
| 4,452,162 A | | 6/1984 | Harbaugh | ..... | 114/74 A |
| 4,513,550 A | | 4/1985 | Kotcharian | ..... | 52/249 |
| 4,625,753 A | | 12/1986 | Gustafson | ..... | 137/202 |

FOREIGN PATENT DOCUMENTS

| | | | |
|---|---|---|---|
| DE | 3103539 | 1/1982 | ..... E04H/7/02 |
| DE | 4038131 | 11/1992 | ..... A61F/7/00 |
| GB | 919755 | 2/1963 | |
| GB | 2087467 | 5/1982 | ..... E04H/7/02 |
| GB | 2119843 | 11/1983 | ..... E04H/7/02 |

OTHER PUBLICATIONS

Goldstone,P.G., et al., "Tonnage Nitrogen Generation for Oil and Gas Enhanced Recovery in the North Sea", presented in the Annual Report, Session 6 of the 9$^{th}$ Continental Meeting of the Gas Processors Association, May 14, 1992.

* cited by examiner

*Primary Examiner*—William C. Doerrler
(74) *Attorney, Agent, or Firm*—Willard Jones, II

(57) ABSTRACT

A containment enclosure (1) for a cryogenic unit (2) has a chamber (7) in which the cryogenic unit (2) is located. A chamber wall (4, 5, 6) includes thermally insulating bricks (10, 11) for thermally insulating the cryogenic unit (2) in the chamber (7). The chamber wall (4, 5, 6) is impermeable to liquid leaking from the cryogenic unit (2). A sump (30) is provided for receiving any liquid leaking from the cryogenic unit (2). Withdrawing means (31) are provided for withdrawing liquid from the sump (30) through an open uppermost end of the sump (30).

24 Claims, 4 Drawing Sheets

FIG. 3
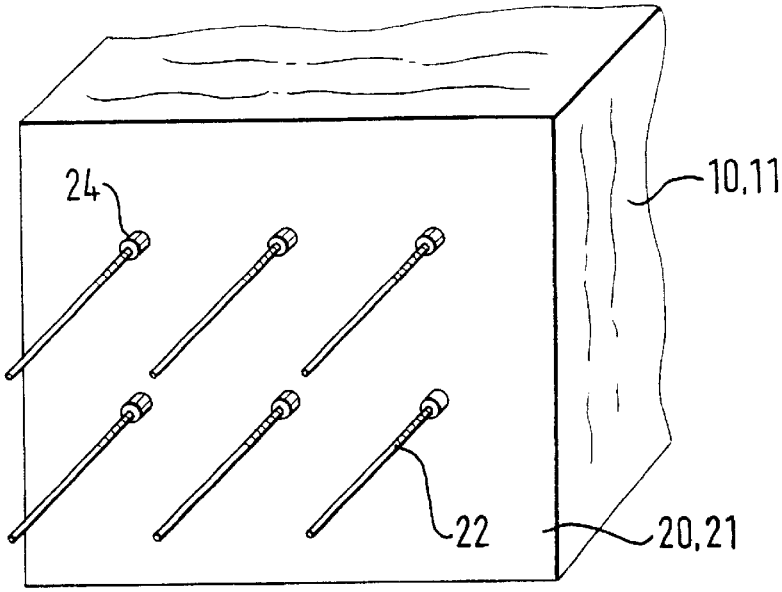
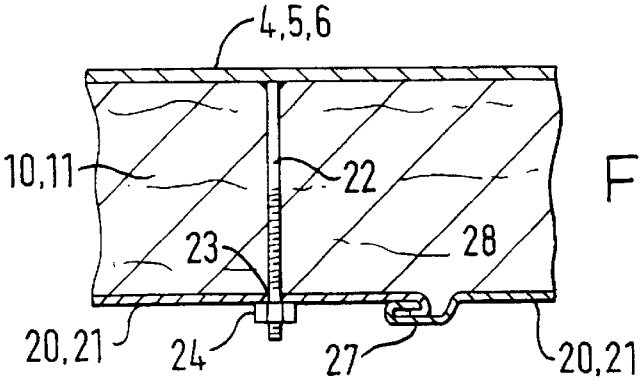
FIG. 4
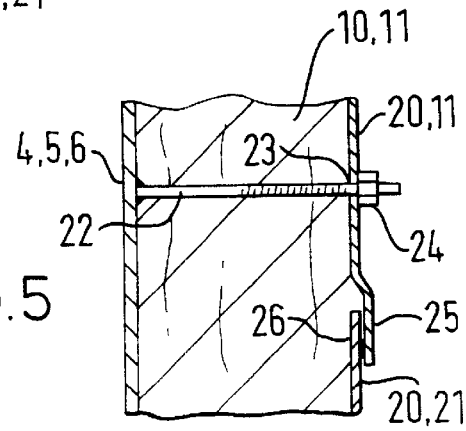
FIG. 5

CONTAINMENT ENCLOSURE

The present invention relates to a containment enclosure for enclosing a cryogenic unit. The containment enclosure has particular application in off-shore locations.

There are many applications which use a cryogenic unit. Such cryogenic units typically include air separation units, gas liquefaction units, and synthesis units. It is sometimes desirable or necessary for reasons of safety to enclose such units, particularly to contain any cryogenic liquids or vapours leaking from the cryogenic unit. Whilst containment enclosures can be desirable in particular in on-shore applications, they are essential in off-shore applications as human operators often have to work and live within a few metres of the cryogenic unit. In many off-shore applications, such as deep sea oil rigs or other platforms and on sea-going vessels, because of the close proximity of the human operators to the cryogenic unit and also because of the difficulties in evacuating human operators from such off-shore applications, containing leaks from a cryogenic unit is of paramount importance.

When a cryogenic liquid or vapour does leak from a cryogenic unit, it is necessary to dispose of or disperse the leaking liquid and/or vapour. In on-shore applications, this can normally simply be achieved by venting the cryogenic liquid and/or vapour to atmosphere. However, venting a cryogenic liquid or vapour to atmosphere can generate a thick fog in the vicinity of the vent, which seriously reduces the visibility in the region of the vent, and can cause icing of neighbouring structures. Moreover, simply venting liquids and vapours to atmosphere can cause a health hazard to human operators working nearby and can cause damage to neighbouring structures, depending on the liquids or vapours which are being vented. For example, where the liquid or vapour is oxygen-rich, there may be a risk of fire or explosion. There is also a risk of structural damage to the carbon steels which are tonically employed in the construction of off-shore rigs by embrittlement fatigue from contact with cryogenic fluids.

In a paper entitled "Tonnage Nitrogen Generation For Oil And Gas Enhanced Recovery In The North Sea" presented in the Annual Report, Session 6 of the 9th Continental Meeting of the Gas Processors Association, 14th May 1992, there is disclosed a containment enclosure for an air separation unit. The containment enclosure disclosed in that paper utilises a known type of thermal insulation in which loose insulation contained by a wire mesh ("chicken wire") forms a thermally insulating layer which is resistant to penetration of cryogenic leaks from the air separation unit. However, the efficiency of the thermal insulation provided by a loose fill of insulation has been found to be very variable as it is difficult to ensure an optimum and consistent density and hence provide minimum thermal conductivity of the loosely filled insulation. Furthermore, the loosely filled insulation is only merely resistant to cryogenic leaks and severe leaks can penetrate the insulation thereby destroying the integrity and effectiveness of the thermal insulation.

Moreover, where maintenance of a cryogenic unit is required, it is necessary to provide some access through any thermal insulation to the cryogenic unit. In an off-shore application, it is especially important to be able to have easy access to the cryogenic unit for maintenance purposes because any delays in providing maintenance access to the cryogenic unit may increase the safety risk to operators. The removal and addition of any loose filled insulation around a cryogenic unit can be very time-consuming and should preferably therefore be avoided particularly in off-shore applications.

In the containment enclosure disclosed in the paper mentioned above, the containment enclosure has a sump at its base which can receive and contain a liquid leaking from the cryogenic unit contained in the containment enclosure. The sump has a stainless steel liner forming the sump wall. In this prior art proposal, liquid can be passed from the sump to a vaporiser which then vaporises the liquid prior to dispersal.

An object of the present invention is to overcome one or more of the problems mentioned above.

U.S. Pat. No. 4,513,550 discloses a method of building a large-scale tank or reservoir for storing a liquid at low temperature.

U.S. Pat. No. 4,452,162 discloses a corner structure for a cryogenic insulation system used as a large-scale container for storage of cryogenic liquefied gases.

U.S. Pat. No. 4,041,722 discloses a large-scale tank for storage of cryogenic liquefied gases.

DE-A-4038131 and U.S. Pat. No. 4,625,753 each disclose an example of a small-scale container for storage of cryogenic liquefied gases.

According to a first aspect of the present invention, there is provided in combination, a containment enclosure and a cryogenic unit, the cryogenic unit being at least one of an air separation unit, a gas liquefaction unit, a gas synthesis unit, and a gas purification unit, the containment enclosure being arranged to contain liquid leaking from the cryogenic unit and comprising a chamber in which the cryogenic unit is located; a chamber wall which includes thermal insulation for thermally insulating the cryogenic unit in the chamber; and, a sump for receiving liquid leaking from the cryogenic unit; characterised in that: the chamber wall is impermeable to liquid leaking from the cryogenic unit.

The containment enclosure can completely contain all leaks from the cryogenic unit located within the chamber. The integrity of the thermal insulation is maintained at all times.

The chamber wall preferably includes a plurality of thermally insulating bricks for thermally insulating the chamber. The bricks are preferably free of any binder. The bricks are most preferably pre-compressed mineral fibre.

The use of thermally insulating bricks rather than a loose fill thermal insulation as in the prior art greatly facilitates assembly of the containment enclosure and also facilitates access to a cryogenic unit within the chamber for maintenance purposes. The thermal insulation Properties of the bricks can be well defined and will usually be within a very narrow range, which is in contrast to the very variable thermal insulation properties of loose filled thermal insulation. It will be appreciated that the word "brick" used herein includes other substantially self-supporting structures such as, for example, blocks and slabs. It is preferred that the bricks be free of any binder in case any oxygen-containing liquid or vapour leaking from the cryogenic unit does come into contact with the bricks as such binders may have a potential to combust on contact with liquids or vapours containing oxygen.

The bricks are preferably arranged in layers, each layer comprising a plurality of bricks, the bricks in at least one layer being staggered relative to the bricks in an adjacent layer such that the abutment between adjacent bricks in said at least one layer is discontinuous with the abutment between adjacent bricks in said adjacent layer. Staggering the bricks in one layer relative to the bricks in an adjacent layer improves the thermal insulation properties of the bricks as it limits the convection pathways for warm air to enter the chamber from outside the containment enclosure.

A convection break is preferably positioned between at least some bricks. The or each convection break may comprise a sheet of substantially gas-impermeable foil.

In a preferred embodiment, studs or pins are provided for securing the bricks to the chamber wall. The studs can be used to locate the bricks relative to the chamber wall and to each other. The studs can be used, in association with an impermeable panel, to compress the bricks if desired, which may be desirable in order to obtain optimum thermal insulation from the bricks.

At least one panel is preferably affixed to the chamber wall between the insulation and the chamber, said at least one panel being impermeable to liquid leaking from the cryogenic unit to render the chamber wall impermeable to liquid leaking from the cryogenic unit. In a preferred embodiment, a plurality of panels is affixed to the chamber wall between the insulation and the chamber, wherein, at a horizontal connection between adjacent upper and lower panels, the lowermost edge of the upper panel overlies the uppermost edge of the adjacent lower panel on the chamber side of said adjacent upper and lower panels. Preferably, at a vertical connection between adjacent plural panels, the adjoining edges of said adjacent panels are interlocked.

The or each panel is preferably of a material which is such as to prevent any liquids or vapours escaping into the chamber from the cryogenic unit from reaching the insulation. The panel or panels therefore provide a shield or protective layer for the insulation. In the preferred embodiment, plural panels are effectively tiled in a manner similar to roof tiles such that a liquid striking and running down the panels is shed by the panels and does not penetrate into the insulation.

The or at least some of the panels are preferably affixed to and compress the thermal insulation by means of studs which pass through said panels into said insulation. The studs may be fixed at one end to an enclosure wall of the enclosure so that the thermal insulation is compressible between said panels and said enclosure wall.

The sump is preferably open at its uppermost end to receive liquid leaking from the cryogenic unit, the sump being defined by a sump wall and a sump base, and comprising withdrawing means for withdrawing liquid from the sump through the open uppermost end of the sump. The withdrawing means normally requires the specific application of energy (for example electrical power/steam/motive gas) to provide a lift capability for withdrawing liquid. Release of the contained cryogen cannot be achieved by accident as the withdrawing means is remotely energised and can only by achieved by operation of the withdrawing means. A vaporiser may be connected to the withdrawing means for receiving and vaporising liquid withdrawn from the sump. Heating means for heating vapour produced by the vaporiser prior to dispersal of said vapour may be provided. The sump is preferably large enough to contain the whole inventory of the cryogenic unit.

The chamber may have at least one side wall which includes a plurality of insulating bricks for thermally insulating the chamber.

The chamber may have a top wall which includes a plurality of insulating bricks for thermally insulating the chamber.

According to a second aspect of the present invention, there is provided in combination, a containment enclosure and a cryogenic unit, the containment enclosure comprising a chamber in which the cryogenic unit is located, the chamber having a chamber wall which includes a plurality of thermally insulating bricks for thermally insulating the chamber.

The bricks are preferably arranged in layers, each layer comprising a plurality of bricks, the bricks in at least one layer being staggered relative to the bricks in an adjacent layer such that the abutment between adjacent bricks in said at least one layer is discontinuous with the abutment between adjacent bricks in said adjacent layer.

There may be a convection break between at least some bricks.

Preferably, at least one panel is affixed to the chamber wall between the bricks and the chamber to render the bricks impermeable to liquid leaking from the cryogenic unit. A plurality of panels may be affixed to the chamber wall between the bricks and the chamber, wherein, at a horizontal connection between adjacent upper and lower panels, the lowermost edge of the upper panel overlies the uppermost edge of the adjacent lower panel on the chamber side of said adjacent upper and lower panels. A plurality of panels may be affixed to the chamber wall between the bricks and the chamber, wherein, at a vertical connection between adjacent panels, the adjoining edges of said adjacent panels are interlocked.

A sump may be provided for receiving liquid leaking from the cryogenic unit, the sump being open at its uppermost end to receive liquid leaking from the cryogenic unit, the sump being defined by a sump wall and a sump base, the enclosure comprising withdrawing means for withdrawing liquid from the sump through the open uppermost end of the sump. There may be a vaporiser connected to the withdrawing means for receiving and vaporising liquid withdrawn from the sump. Heating means may be provided for heating vapour produced by the vaporiser prior to dispersal of said vapour.

Where panels are provided, the bottom edge of the panels can project beyond the upper lip of the sump to shed liquid without permitting penetration through the insulation behind.

According to a third aspect of the present invention, there is provided in combination, a containment enclosure and a cryogenic unit, the containment enclosure comprising a chamber in which the cryogenic unit is located; a chamber wall which includes thermal insulation for thermally insulating the cryogenic unit in the chamber; a sump for receiving liquid leaking from the cryogenic unit, the sump being open at its uppermost end to receive liquid leaking from the cryogenic unit, the sump being defined by a sump wall and a sump base; and, withdrawing means for withdrawing liquid from the sump through the open uppermost end of the sump.

A vaporiser may be connected to the withdrawing means for receiving and vaporising liquid withdrawn from the sump. Heating means for heating vapour produced by the vaporiser prior to dispersal of said vapour may be provided.

In a preferred embodiment, the sump comprises a sealed membrane of stainless steel or aluminium supported by a floor and walls of glass foam blocks sandwiched between the membrane and the carbon steel outer surface of the enclosure. The foam glass blocks are preferably multi-layered and staggered to avoid continuous abutments through the wall and are laid without adhesive to allow for thermal movement. The faces of adjoining blocks may have a woven glass fibre blanket layer to prevent abrasion of the blocks.

The combination may be situated in an off-shore location.

The cryogenic unit may be an air separation unit or a gas liquefaction unit or a purification or separation unit for other gases.

An embodiment of the present invention will now be described by way of example with reference to the accompanying drawings, in which:

FIG. 3 is a schematic perspective view showing a panel and thermal insulation;

FIG. 4 is a partial cross-sectional view from above of a chamber wall, insulation and panels;

FIG. 5 is a partial cross-sectional view from the side of a chamber wall, insulation and panels;

Figures 1, 2A, 2B:
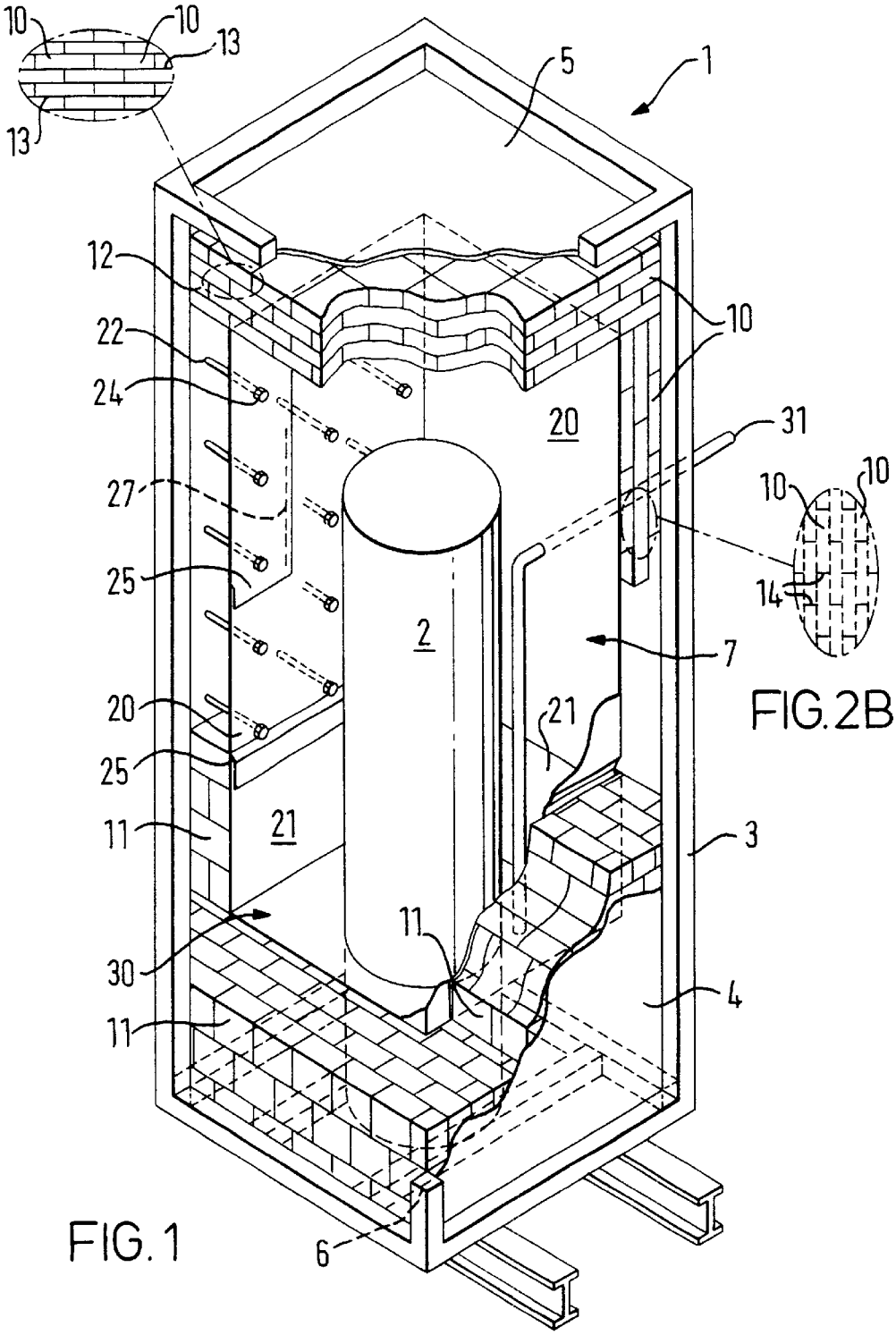
FIG. 1 is a perspective partially cut away view of an example of a containment enclosure and a cryogenic unit according to the present invention.
FIGS. 2A and 2B are detailed views of portions of the thermal insulation for the walls and roof of the panels in the enclosure area above the sump.
Figure 6:
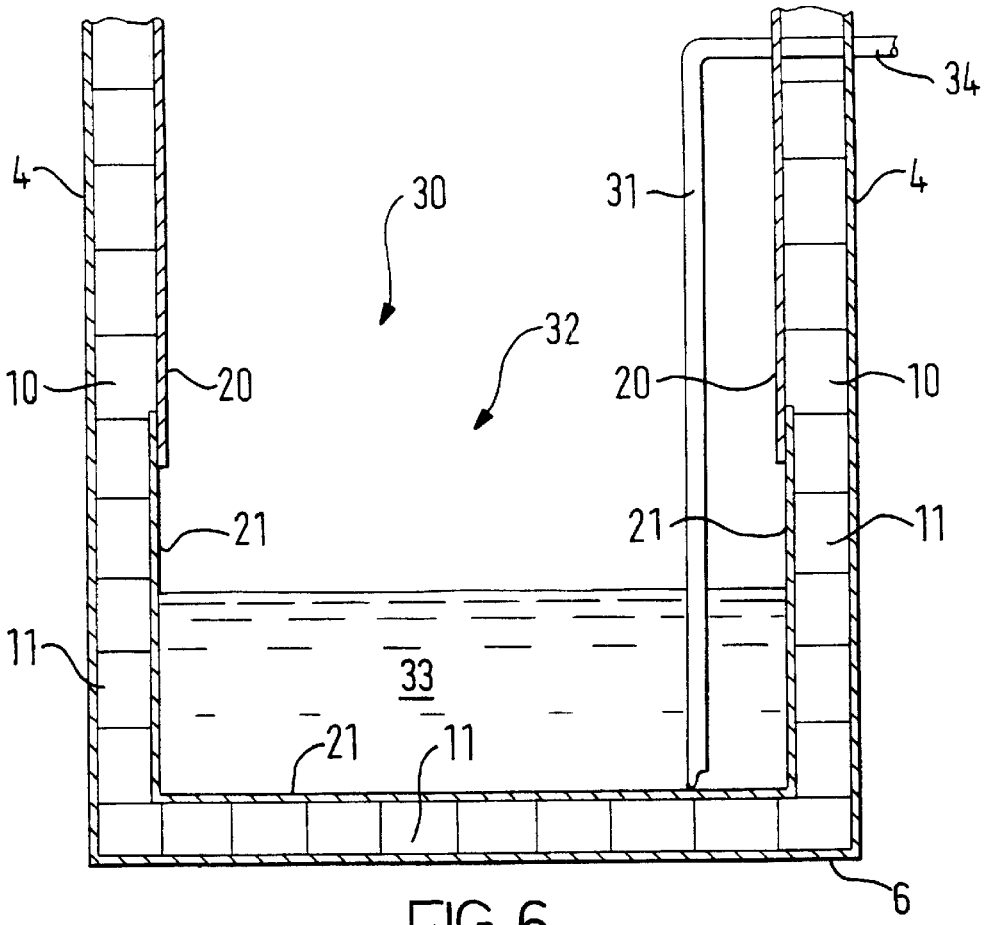
FIG. 6 is a schematic view of the lower portion of the enclosure showing a sump.

Referring to the drawings, there is shown a containment enclosure 1 for a cryogenic unit 2. The cryogenic unit 2 may for example be an air separation unit, a gas (such as natural gas) liquefaction unit, a gas separation and/or purification unit for gases such as CO and/or $H_2$, etc. The containment enclosure 1 is particularly suitable for use in off-shore applications, for example on oil/gas production platforms or on board a ship for example.

The containment enclosure 1 is shown partially cut away in FIG. 1 for reasons of clarity. The containment enclosure 1 may be cylindrical or rectangular in cross section but it will be appreciated that other shapes are possible within the scope of the present invention. References to "side wall" or "side walls", etc, will be understood accordingly.

The enclosure 1 has an external frame 3 formed of rectangular section frame members which are welded or otherwise fixed together. The enclosure 1 has outer side walls 4, an outer top wall 5, and an outer bottom wall 6, each of which is fixed to the frame 3. The frame and outer walls 4,5,6 are preferably carbon steel plates. The enclosure 1 has a central chamber 7 in which the cryogenic unit 2 is housed.

Positioned internally of and adjacent to the outer walls 4,5,6 are layers of thermally insulating bricks 10,11. It will be appreciated that only some of the bricks 10,11 are shown in FIG. I for reasons of clarity. The bricks 10 which line the upper portions of the outer side walls 4 and the top wall 5 are preferably preformed bricks or slabs of mineral fibre insulation. A particularly suitable material is low density rockwool. The bricks 11 which line the lower portion of the outer side panels 4 and the bottom panel 6 are preferably preformed bricks or slabs of foam glass as will be described further below.

As can be seen in FIG. 1, the bricks 10,11 are provided in horizontal and vertical layers, the majority of which have a thickness of several bricks 10,11. The bricks 10,11 in adjacent layers are staggered relative to each other such that the abutment 12 between adjacent bricks in one layer is not continuous with an abutment 12 between adjacent bricks 10,11 in an adjacent layer. As far as possible within the confines of the stacking arrangement of the bricks 10,11, this staggering of the bricks 10,11 relative to each other in adjacent layers is utilised for all adjacent layers, both vertically and horizontally. The staggering of the bricks 10,11 in this manner improves the thermal insulation properties of the layers of bricks 10,11 as convection pathways for warm air or other gas or gases to pass from outside the enclosure 1 to within the enclosure 1 are minimised or absent altogether.

The thermal insulation properties of the upper bricks 10 are further improved by the presence of convection breaks between adjacent bricks 10, especially bricks 10 which are adjacent in a vertical direction. For example, as shown in FIG. 2A for the bricks 10 adjacent the top outer panel 5, sheets 13 of thin aluminium foil are laid between successive horizontal layers of bricks 10 to prevent heat being convected through the upper layer of bricks 10. Similarly, as shown in FIG. 2B, thin layers 14 of aluminium foil are interposed between the horizontal abutment between vertically adjacent bricks 10. As well as hindering or preventing passage of warm gas or gases through any spaces between adjacent bricks 10, the convection breaks 13,14 also serve to inhibit flow of warm gas or gases through the bricks 10 themselves. Indeed, in some circumstances, it may be desirable to wrap the whole of some or all of the bricks 10 in a convection break, for example aluminium foil, to minimise yet further possible convection losses.

The innermost surfaces of the innermost bricks 10 for the upper walls and roof of the enclosure are lined with impermeable panels 20. Those panels 20 adjacent to the bricks 10 in the upper part of the enclosure 1 above the containment sump may be stainless steel or aluminium for example and may have a thickness of 3 mm.

As shown in FIG. 1 and more clearly in FIGS. 3 to 5, studs 22 are fixed in a regular array to the outer top panel 5 and the upper portions of the outer side panels 4 for example by welding so that the studs 22 project from the outer top and side panels 4,5 into the interior of the enclosure 1. The mineral fibre bricks 10 in the upper part of the enclosure 1 are impaled on the studs 22, the studs 22 thereby helping to secure the bricks 10 in position relative to each other. The upper inner lining panels 20 which line and protect the upper bricks 10 have through holes 23 positioned to correspond to the studs 22. Thus, after the bricks 10 have been impaled on the studs 22, the various inner lining panels 20 can be offered up to the bricks 10 and positioned on the studs 22 with each stud 22 passing through a respective through hole 23 in the panels 20. The free ends of the studs 22 are screw threaded to receive a lock nut 24. The lock nuts 24 are tightened up to a predetermined torque to secure the inner lining panels 20 on the studs 22. The torque is determined so that the bricks 10 are compressed with a force such as to optimise the density and hence the thermal insulation properties of the bricks 10. It will be understood that the bricks 10 will normally become more thermally conductive but less thermally convective as the bricks 10 are further compressed and thus a balance between minimum thermal conduction and minimum thermal convection can be obtained by choosing an appropriate torque. It will be appreciated that the torque on a particular stud 22 and nut 24 may be different according to the location of that stud 22 and nut 24 in the enclosure 1, the number and thickness of bricks 10 impaled on that stud 22, and the material of the brick 10 impaled on that stud 22.

Because of the large size of the containment enclosure 1, which may be several tens of metres high, it will usually be necessary to provide several inner lining panels 20 for each inner wall of the enclosure 1. As shown in FIGS. 1 and 5, the lowermost horizontal edge 25 of each vertically positioned inner lining panel 20 in the upper part of the enclosure 1 has a lazy Z cross-sectional shape so that that lowermost horizontal edge 25 overlaps the uppermost horizontal edge 26 of the immediately adjacent lower inner lining panel 20. This arrangement helps to ensure that the inner lining panels 20 shed any liquid striking the inner lining panels 20 from the cryogenic unit 2 such that any such liquid flows down the innermost surfaces of the inner lining panels 20 towards the bottom of the enclosure 1 and such liquid does not penetrate into the material of the bricks 10.

As shown particularly clearly in FIG. 4, the adjacent vertical edges 27,28 of the inner lining panels 20 are interlocked, again to prevent penetration of any liquid through the panels 20 into the material of the bricks 10. As shown in FIG. 4, the interlocking can be achieved by the vertical edges 27,28 of the inner lining panels 20 being curved back on themselves to have opposed generally C-shape cross sections as viewed from above, the C-section edges 27,28 interlinking in order to lock the panels 20 together at their vertically adjacent edges.

The tile-like overlapping at the horizontal edges of the panels 20 and the interlocking at the vertical edges of the panels 20 also allow for thermal movement of the panels 20, which can be very important as the panels 20 can be subject to wide temperature variations.

The lowermost portion of the enclosure 1 is formed as a sump 30 which is preferably large enough to contain the whole inventory of liquid used in or produced by the cryogenic unit 2 in case of a serious leakage whereby all such liquid escapes from the cryogenic unit 2. The sump 30 is preferably large enough to contain all such liquid even if the cryogenic unit 2 is mounted on a ship or off-shore platform where the enclosure 1 is subject to rocking movement which will cause liquid in the sump 30 to move about. The inner lining panels 21 at the lowermost portion of the enclosure 1 are aluminium or stainless steel. These lowermost inner lining panels 21 are welded together to form the side walls and base of the sump 30 and potentially may be exposed to prolonged contact with cryogenic liquids. Foam glass insulation is relatively expensive and, whilst it could be used as the material for all of the bricks 10,11, in order to keep down costs, only the bricks 11 sandwiched between the sump 30 and the outer panels 4 of the enclosure 1 to insulate the sump 30 are formed from foam glass where the compressive strength of the foam glass can be used to maximum advantage. As stated above, the bricks 10 used for thermally insulating the uppermost portions of the enclosure 1 can be made from mineral fibre, such as rockwool, which is less expensive.

At the junction of the upper and lower (sump) sections of the enclosure 1, the lower horizontal edge of the cladding plates 25 overlap the top section of the sump lining plates 21 in order to shed any leaked liquid directly into the sump without penetration into the insulation bricks 10,11.

It is preferred that there are no through holes whatsoever in the panels 21 which line the side and bottom of the sump 30 so as to reduce to a minimum the likelihood of liquid or vapour escaping through the side or bottom of the sump 30. In order to remove liquid collected in the sump 30 after a leak has occurred, a dip tube 31 extends from a position near the bottom of the sump 30 up through the open uppermost end 32 of the sump 30 and out through one of the upper inner lining panels 20, and the adjacent upper insulation bricks 10 and outer panel 4. Liquid 33 in the bottom of the sump 30 is withdrawn through the dip tube 31 by any suitable method such by applying low pressure to the free end 34 of the dip tube 31, by means of a venturi ejector, or by introducing high pressure gas such as air into the region of the sump 30 above the liquid 33 to force the liquid 33 up the dip tube 31. The liquid drawn out can be vaporised by heat exchange with sea water in an adjacent heat exchanger which may have its own separate secondary containment sump. The vapour so produced can then be superheated by electrical heating or by heat exchange with a gas turbine exhaust for example. This superheating of the vapour ensures that the vapour can then be released without creating fogging or icing in the vicinity of the final vent from the superheater and without causing explosive vaporisation which can otherwise occur by direct dumping of a cryogenic liquid onto the surface of the sea. Because of the capacity of the sump 30 to contain the whole of the liquid which might leak from the cryogenic unit 2, there is no need to dispose of the collected liquid 33 immediately and the liquid 33 can be disposed of or dispersed as described above under controlled conditions.

As mentioned above, the lower bricks 11 in the region of the sump 30 are preferably of foam glass where the compressive strength of the foam glass can be used to maximum advantage. The foam glass bricks 11 are multi-layered and staggered to avoid continuous abutments through the wall and are laid without adhesive to allow for thermal movement. The faces of adjoining bricks 11 may have a woven glass fibre blanket layer or a thin layer of lass fibre powder as a lubricant to prevent abrasion of the bricks 11 if the bricks 11 move due to thermal expansion and contraction.

Figure 7:
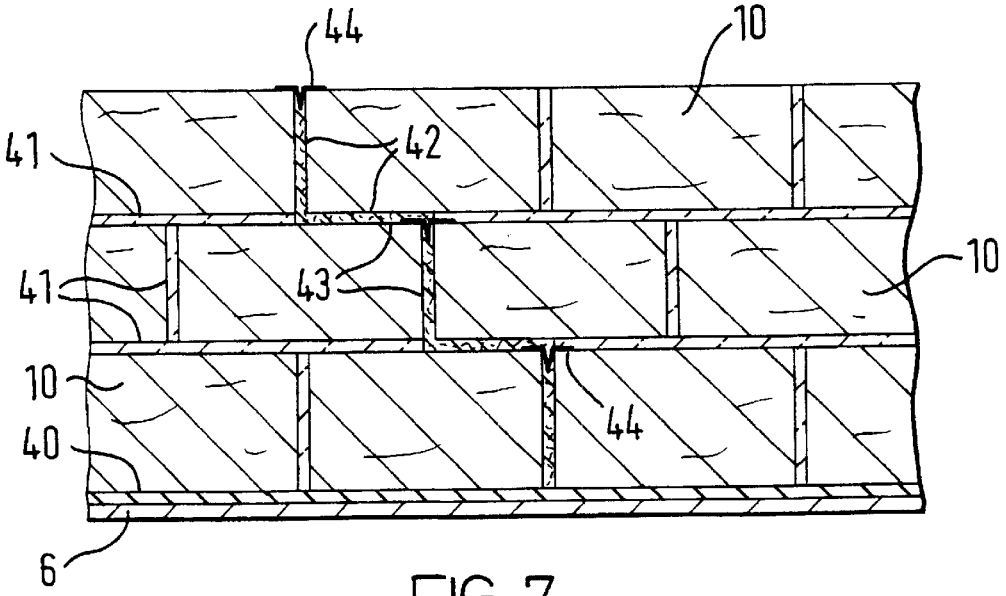
FIG. 7 is a detailed cross-sectional view of the thermal insulation in the wall and roof using foam glass as an alternative insulation medium to compressed mineral fibres; and, FIG. 8 is a schematic perspective view of a sealing clip for a foam glass wall or roof installation.

If foam glass is used for all of the insulation bricks 10,11 for the enclosure 1, then the upper bricks 10 that are above the liquid containment sump 30 cannot be loose laid and require a different method of attachment as shown in FIG. 7.

Figure 8:
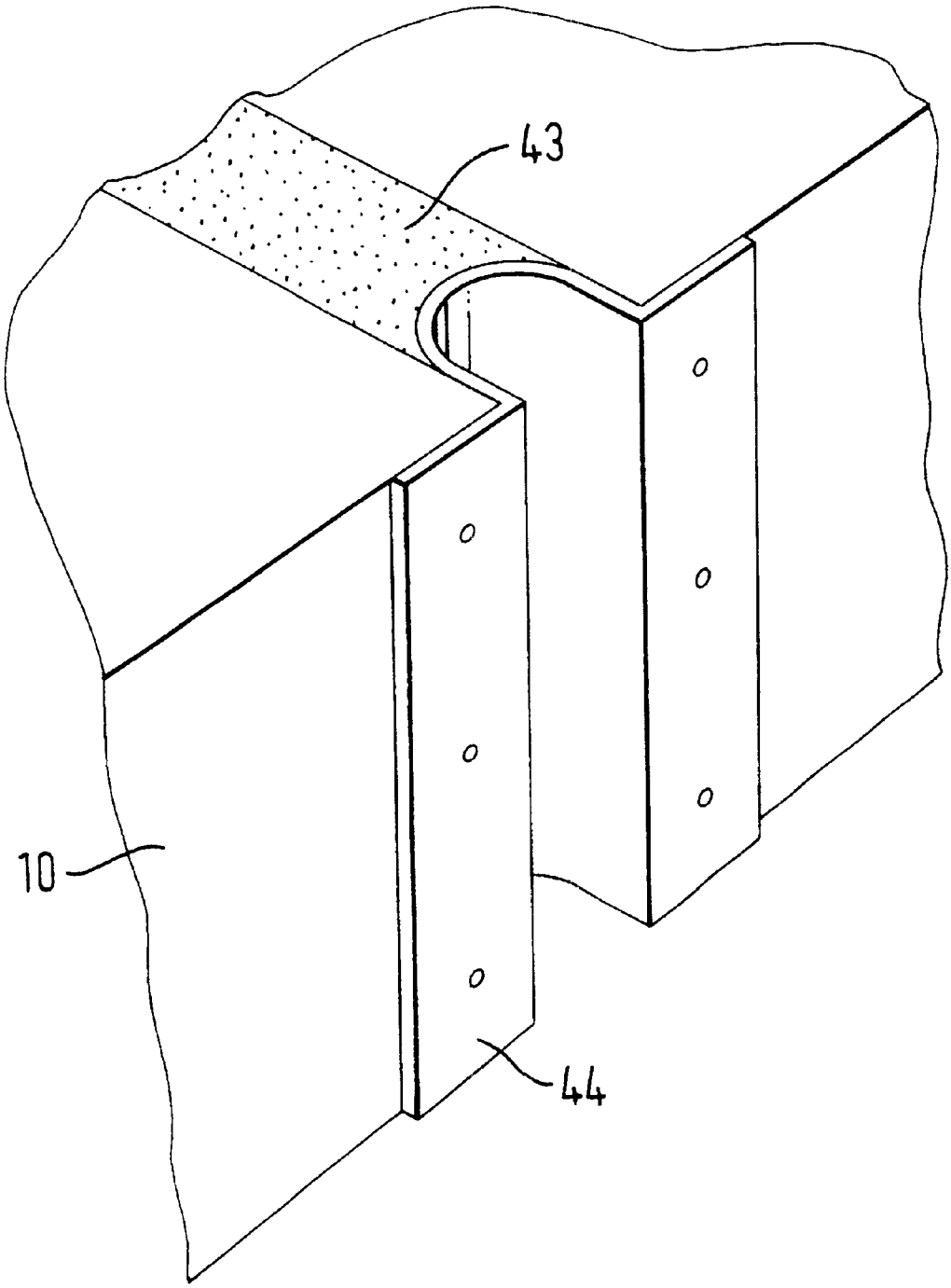

Referring to FIG. 7, there are three horizontal layers of foam glass bricks 10 forming the insulation layer above the cryogenic sump 30. The bricks 10 in the initial layer are bonded to the outer panel 6 of the enclosure 1 using an adhesive such as epoxy rubber 40 which provides some flexibility in the bond between the outermost bricks 10 and the outer panel 6 where temperatures are close to ambient. Epoxy rubber cement can be used because foam glass is impervious and therefore the epoxy rubber cement would not normally be subject to reaction with any gases, such as oxygen or oxygen-rich mixtures, which might otherwise diffuse through the bricks 10. The second layer of bricks 10 is bonded to the first layer and the third layer of bricks 10 is bonded to the second layer by standard glass cement 41 which can also be used between adjacent bricks 10 within a layer. As shown in FIG. 7, some bricks 10 within a horizontal layer are not bonded to each other and, similarly, at least some portions of bricks 10 are not bonded to bricks 10 in a vertically adjacent layer. Instead, expansion gaps 42 are left between such bricks 10 to accommodate thermal expansion and contraction of the bricks 10 between ambient and cryogenic temperatures. The gaps 42 are filled with mineral fibre insulation 43, such as rockwool, to provide thermal insulation in the gaps 42. The gaps 42 are further sealed with custom-made stainless steel expandable spring clips 44 having a U-shape cross-section as shown most clearly in FIG. 8.

A relief valve (not shown) may be provided so that vapours leaking from the cryogenic unit 2 into the interior chamber of the enclosure 1 can escape. The outlet from such a relief valve is preferably in thermal contact with a heat source or may be connected to pass the escaping vapour directly to a hot gas stream so that the vapour escaping from the interior chamber of the enclosure 1 is warmed to near or above ambient temperature before the vapour is actually dispersed into the atmosphere, again to prevent icing and fogging from occurring.

The present invention, in its various aspects, provides a containment enclosure which has particular application in an off-shore location. It will nevertheless be appreciated that the containment enclosure 1 can be used in on-shore applications. In its preferred embodiment, the containment enclosure 1 provides excellent thermal insulation for any cryogenic unit process within the interior chamber 7 of the enclosure 1. The thermal insulation material itself is well protected from any liquids and vapours which might escape from the cryogenic unit 2 as the inner lining panels 20 can be completely impervious to leaking liquids and vapours. A sump 30 for leaking liquid is provided which has sump walls which are free of any through holes or other openings for pipes, etc. As such, the integrity of the sump walls is ensured. Any liquid or vapour which has leaked from the cryogenic unit 2 can be drawn off or allowed to escape to a heat exchanger where the liquid or vapour is warmed to near or above ambient temperature. This is especially important in an off-shore application in order to prevent fogging and icing and also to prevent cryogenic liquids from embrittling and fatiguing the structural steel or other materials of the platform or vessel on which the enclosure 1 is mounted. In the preferred embodiment where inner lining panels 20 are fixed in position with studs 22 and locking nuts 24, the insulation bricks 10 can be compressed to a predetermined compression by screwing up the lock nuts 24 to a predetermined torque. This optimises the density and hence the insulation quality of the layers and minimises convection paths along brick boundaries. Insulation bricks 10 usually have phenolic binders to retain the shape of the brick 10. Such binders are typically not oxygen-compatible and should therefore be avoided in applications where there is even a small risk of contact of such bricks with oxygen or oxygen-rich mixtures.

An embodiment of the present invention has been described with particular reference to the example illustrated. However, it will be appreciated that variations and modifications may be made to the example described within the scope of the present invention as defined by the appended claims.

What is claimed is:

1. In combination, a containment enclosure and a cryogenic unit, the cryogenic unit being at least one of an air separation unit, a gas liquefaction unit, a gas synthesis unit, and a gas purification unit, the containment enclosure being arranged to contain liquid leaking from the cryogenic unit and comprising a chamber in which the cryogenic unit is located; a chamber wall which includes thermal insulation for thermally insulating the cryogenic unit in the chamber; and a sump for receiving liquid leaking from the cryogenic unit; wherein the chamber wall is impermeable to liquid leaking from the cryogenic unit.

2. A combination according to claim 1, wherein the chamber wall includes a plurality of thermally insulating bricks for thermally insulating the chamber.

3. (Amended) In combination, a containment enclosure and a cryogenic unit, the cryogenic unit being at least one of an air separation unit, a gas liquefaction unit, a gas synthesis unit, and a gas purification unit, the containment enclosure being arranged to contain liquid leaking from the cryogenic unit and comprising: a chamber in which the cryogenic unit is located; a chamber wall which includes thermal insulation for thermally insulating the cryogenic unit in the chamber; and a sump for receiving liquid leaking from the cryogenic unit; wherein the chamber wall is impermeable to liquid leaking from the cryogenic unit, wherein the chamber wall includes a plurality of thermally insulating bricks for thermally insulating the chamber, the bricks being free of any binder.

4. In combination, a containment enclosure and a cryogenic unit, the cryogenic unit being at least one of an air separation unit, a gas liquefaction unit, a gas synthesis unit, and a gas purification unit, the containment enclosure being arranged to contain liquid leaking from the cryogenic unit and comprising: a chamber in which the cryogenic unit is located; a chamber wall which includes thermal insulation for thermally insulating the cryogenic unit in the chamber; and a sump for receiving liquid leaking from the cryogenic unit; wherein the chamber wall is impermeable to liquid leaking from the cryogenic unit, wherein the chamber wall includes a plurality of thermally insulating bricks for thermally insulating the chamber, the bricks being arranged in layers, each layer comprising a plurality of bricks, the bricks in at least one layer being staggered relative to the bricks in an adjacent layer such that the abutment between adjacent bricks in said at least one layer is discontinuous with the abutment between adjacent bricks in said adjacent layer.

5. In combination, a containment enclosure and a cryogenic unit, the cryogenic unit being at least one of an air separation unit, a gas liquefaction unit, a gas synthesis unit, and a gas purification unit, the containment enclosure being arranged to contain liquid leaking from the cryogenic unit and comprising: a chamber in which the cryogenic unit is located; a chamber wall which includes thermal insulation for thermally insulating the cryogenic unit in the chamber; and a sump for receiving liquid leaking from the cryogenic unit; wherein the chamber wall is impermeable to liquid leaking from the cryogenic unit, wherein the chamber wall includes a plurality of thermally insulating bricks for thermally insulating the chamber, and comprising a convection break between at least some bricks.

6. A combination according to claim 5, wherein the or each convection break comprises a sheet of substantially gas-impermeable foil.

7. In combination, a containment enclosure and a cryogenic unit, the cryogenic unit being at least one of an air separation unit, a gas liquefaction unit, a gas synthesis unit, and a gas purification unit, the containment enclosure being arranged to contain liquid leaking from the cryogenic unit and comprising: a chamber in which the cryogenic unit is located; a chamber wall which includes thermal insulation for thermally insulating the cryogenic unit in the chamber; and a sump for receiving liquid leaking from the cryogenic unit; wherein the chamber wall is impermeable to liquid leaking from the cryogenic unit, wherein the chamber wall includes a plurality of thermally insulating bricks for thermally insulating the chamber, and comprising studs for securing the bricks to the chamber wall.

8. A combination according to claim 1, comprising at least one panel affixed to the chamber wall between the insulation and the chamber, said at least one panel being impermeable to liquid leaking from the cryogenic unit to render the chamber wall impermeable to liquid leaking from the cryogenic unit.

9. In combination, a containment enclosure and a cryogenic unit, the cryogenic unit being at least one of an air separation unit, a gas liquefaction unit, a gas synthesis unit, and a gas purification unit, the containment enclosure being arranged to contain liquid leaking from the cryogenic unit and comprising: a chamber in which the cryogenic unit is located; a chamber wall which includes thermal insulation for thermally insulating the cryogenic unit in the chamber; and a sump for receiving liquid leaking from the cryogenic unit; wherein the chamber wall is impermeable to liquid leaking from the cryogenic unit, and comprising a plurality of panels affixed to the chamber wall between the insulation and the chamber, said panels being impermeable to liquid leaking from the cryogenic unit to render the chamber wall impermeable to liquid leaking from the cryogenic unit, wherein, at a horizontal connection between adjacent upper and lower panels, the lowermost edge of the upper panel overlies the uppermost edge of the adjacent lower panel on the chamber side of said adjacent upper and lower panels.

10. In combination, a containment enclosure and a cryogenic unit, the cryogenic unit being at least one of an air separation unit, a gas liquefaction unit, a gas synthesis unit, and a gas purification unit, the containment enclosure being arranged to contain liquid leaking from the cryogenic unit and comprising: a chamber in which the cryogenic unit is located; a chamber wall which includes thermal insulation for thermally insulating the cryogenic unit in the chamber; and a sump for receiving liquid leaking from the cryogenic unit; wherein the chamber wall is impermeable to liquid leaking from the cryogenic unit, and comprising a plurality of panels affixed to the chamber wall between the insulation and the chamber, said panels being impermeable to liquid leaking from the cryogenic unit to render the chamber wall impermeable to liquid leaking from the cryogenic unit, wherein, at a vertical connection between adjacent panels, the adjoining edges of said adjacent panels are interlocked.

11. In combination, a containment enclosure and a cryogenic unit, the cryogenic unit being at least one of an air separation unit, a gas liquefaction unit, a gas synthesis unit, and a gas purification unit, the containment enclosure being arranged to contain liquid leaking from the cryogenic unit and comprising: a chamber in which the cryogenic unit is located; a chamber wall which includes thermal insulation for thermally insulating the cryogenic unit in the chamber; and a sump for receiving liquid leaking from the cryogenic unit; wherein the chamber wall is impermeable to liquid leaking from the cryogenic unit; and further comprising at least one panel affixed to the chamber wall between the insulation and the chamber, said at least one panel being impermeable to liquid leaking from the cryogenic unit to render the chamber wall impermeable to liquid leaking from the cryogenic unit, wherein the or at least some of the panels are affixed to and compress the thermal insulation by studs which pass through said panels into said insulation.

12. A combination according to claim 11, wherein the studs are fixed at one end to an enclosure wall of the enclosure so that the thermal insulation is compressible between said panels and said enclosure wall.

13. A combination according to claim 1, wherein the sump is open at its uppermost end to receive liquid leaking from the cryogenic unit, the sump being defined by a sump wall and a sump base, and comprising a withdrawing device constructed and arranged to withdraw liquid from the sump through the open uppermost end of the sump.

14. A combination according to claim 13, comprising a vaporizer connected to the withdrawing device for receiving and vaporizing liquid withdrawn from the sump.

15. A combination according to claim 14, comprising a heater for heating vapor produced by the vaporizer prior to dispersal of said vapor.

16. A combination according to claim 1, wherein the chamber has at least one side wall which includes a plurality of insulating bricks for thermally insulating the chamber.

17. A combination according to claim 1, wherein the chamber has a top wall which includes a plurality of insulating bricks for thermally insulating the chamber.

18. In combination, a containment enclosure and a cryogenic unit, the containment enclosure comprising a chamber in which the cryogenic unit is located; a chamber wall which includes thermal insulation for thermally insulating the cryogenic unit in the chamber; a sump for receiving liquid leaking from the cryogenic unit, the sump being open at its uppermost end to receive liquid leaking from the cryogenic unit, the sump being defined by a sump wall and a sump base; and a withdrawing device constructed and arranged to withdraw for withdrawing liquid from the sump through the open uppermost end of the sump.

19. A combination according to claim 18, comprising a vaporizer connected to the withdrawing device for receiving and vaporizing liquid withdrawn from the sump.

20. A combination according to claim 19, comprising a heater for heating vapor produced by the vaporizer prior to dispersal of said vapor.

21. A combination according to claim 1, the combination being situated in an off-shore location.

22. A combination according to claim 1, wherein the cryogenic unit is an air separation unit.

23. A combination according to claim 1, wherein the cryogenic unit is a gas liquefaction unit.

24. A combination according to claim 1, wherein the cryogenic unit is a gas purification or separation process unit.

* * * * *